US007600335B2

(12) United States Patent
Suprina

(10) Patent No.: US 7,600,335 B2
(45) Date of Patent: Oct. 13, 2009

(54) ADAPTABLE STAND ALONE FURNITURE AND GEAR

(76) Inventor: Scott Suprina, 91 Austin Blvd., Commack, NY (US) 11725

( * ) Notice: Subject to any disclaimer, the term of this patent is extended or adjusted under 35 U.S.C. 154(b) by 23 days.

(21) Appl. No.: 12/072,957

(22) Filed: Mar. 1, 2008

(65) Prior Publication Data

US 2008/0209776 A1 Sep. 4, 2008

Related U.S. Application Data

(60) Provisional application No. 60/904,594, filed on Mar. 2, 2007.

(51) Int. Cl.
*G09F 3/00* (2006.01)

(52) U.S. Cl. ..... 40/320; 297/217.1

(58) Field of Classification Search ..... 40/320, 40/642.02, 649; 297/217.1, 228.13, 452.38
See application file for complete search history.

(56) References Cited

U.S. PATENT DOCUMENTS

| | | | |
|---|---|---|---|
| 1,304,753 | A | 5/1919 | Dwyer |
| 1,395,153 | A | 10/1921 | Schomacker |
| 2,517,433 | A | 8/1950 | Hoven |
| 2,627,303 | A | 2/1953 | Bard |
| 2,792,875 | A | 5/1957 | Pirrone |
| 2,876,566 | A | 3/1959 | Harrington |
| 2,980,169 | A | 4/1961 | Campbell |
| 2,986,743 | A | 6/1961 | Eilen |
| 3,283,433 | A | 11/1966 | Navarino |
| 3,873,151 | A | 3/1975 | Morris |
| 4,470,630 | A | 9/1984 | Shields |
| 5,302,001 | A | 4/1994 | van Dis |
| 5,364,163 | A | 11/1994 | Hardison |
| 5,690,380 | A | 11/1997 | Waters |
| 5,887,942 | A | 3/1999 | Allegro, Jr. |
| 5,943,698 | A | 8/1999 | Blanks |
| 6,067,660 | A | 5/2000 | Contini |
| 6,082,816 | A | 7/2000 | Gottlieb et al. |
| 6,151,736 | A | 11/2000 | Samuels |
| 6,189,968 | B1 | 2/2001 | Emanuel et al. |
| 6,309,017 | B1 | 10/2001 | Middleton |
| 6,336,221 | B1 | 1/2002 | Blauer et al. |
| 6,408,438 | B1 | 6/2002 | Mc Kee |

(Continued)

OTHER PUBLICATIONS

Suprina, Scott. "DreamSeat" http://www.dreamseat.com (NOTE: These Dreamseats have permanent non-interchangeable logos).

*Primary Examiner*—Lesley D Morris
*Assistant Examiner*—Shin Kim
(74) *Attorney, Agent, or Firm*—James M. Loeffler, Esq.

(57) ABSTRACT

A system optionally attaches non-reversible, interchangeable fabric, leather, vinyl or other natural or synthetic covering material logo (or advertisement, signage or art) panels to one or more items, such as articles of furniture or personal gear including clothing, sports equipment, and memorabilia frames. The items may include upholstered or non-upholstered sports stadium chairs or other soft-covered items such as leather jackets or golf bags without detracting from their appearance, even if the panel is removed. The panels can also be applied to vehicle seats, public furniture, office furniture, water coolers, or other domestic furniture. The attachment is inconspicuous and hidden from view. Such a logo panel can also cover an area emblazoned with a permanent different logo. These panels can be embroidered sports memorabilia with spaces for actual team member signatures or performer autographs, or they can be corporate logos or promotional advertising panels.

32 Claims, 11 Drawing Sheets

U.S. PATENT DOCUMENTS

| | | | |
|---|---|---|---|
| 6,511,198 | B1 | 1/2003 | Erickson |
| 6,540,302 | B1 | 4/2003 | Crocker et al. |
| 6,604,789 | B1 | 8/2003 | Downing |
| 6,634,709 | B1 | 10/2003 | Hetherington |
| 6,733,082 | B1 | 5/2004 | Treon |
| 6,888,950 | B2 | 5/2005 | Siskin et al. |
| 6,899,391 | B1 | 5/2005 | Schneller et al. |
| 7,121,621 | B1 | 10/2006 | Starheim et al. |
| 7,131,225 | B2 | 11/2006 | Wu |
| 2002/0074839 | A1 | 6/2002 | Mahan |
| 2003/0051317 | A1 | 3/2003 | Preziosi et al. |
| 2003/0056866 | A1 | 3/2003 | Sheppard, Jr. |
| 2004/0036328 | A1 | 2/2004 | Johnson |
| 2005/0206207 | A1 | 9/2005 | Kenny |
| 2005/0206209 | A1 | 9/2005 | Schweikarth et al. |
| 2006/0087165 | A1 | 4/2006 | Gharabegian |
| 2006/0097552 | A1 | 5/2006 | Hampton et al. |
| 2006/0108844 | A1 | 5/2006 | Suprina |
| 2006/0175878 | A1 | 8/2006 | Pontes |
| 2006/0284438 | A1 | 12/2006 | Carty |
| 2007/0018491 | A1 | 1/2007 | Jones |
| 2007/0107277 | A1 | 5/2007 | Simms et al. |
| 2007/0163689 | A1 | 7/2007 | Pace et al. |

ADAPTABLE STAND ALONE FURNITURE AND GEAR

RELATED APPLICATIONS

This application claims benefit under 35 U.S.C. 119(e) from provisional application No. 60/904,594 filed Mar. 2, 2007, which application is incorporated by reference herein.

FIELD OF THE INVENTION

The present invention relates to a system of providing adaptable, stand alone articles of furniture or other personal gear, which are finished, aesthetically pleasing products, but which optionally can accept interchangeable flexible logo or advertising panels. When the panels are removed, the removal in no way detracts from the original beauty and appearance of the original product, so that when the viewer is looking at the product, the user is unaware that the logo panels can be added, let alone interchanged.

BACKGROUND

Indicia attached to chairs or seat cushions is known in the art. Schneller et al. in U.S. Pat. No. 6,899,391 describes a flap extending from the top of a stadium seat support panel to present advertising to a person seated behind. Pontes describes an inflatable seat cushion with a display message or logo on one side in US Patent application number 2006/0175878. In US Patent application number 2006/0284438, Carty describes a single embodiment of flexible logo panel attached to the upper back of an upholstered chair using a hook and loop attachment method. Sapp in U.S. Pat. No. 5,940,909 describes a decorative interchangeable and reversible furniture and/or bed pillow, which can be turned inside-out.

The prior art does not reveal interchangeable fabric, leather, vinyl or other suitable natural or synthetic chair-covering material logo or advertising panels attached to upholstered chairs using methods which do not detract from the appearance or comfort, or visibility of the chair when the logo panel is not present.

None of the prior art logo attachable products can be utilized on anything other than their original products. In the prior art products, when an advertising logo is removed, it detracts from the products, and lack thereof detracts from the appearance and usefulness of the product.

OBJECTS OF THE INVENTION

It is an object of the present invention to provide a system and method for providing adaptable, stand alone personal or commercial product items, such as furniture, sports equipment or clothing, with or without removable interchangeable fabric logo panels of distinctive design.

It is also an object of the present invention to provide a personal product item, which can receive one or more logo panels of distinctive designs, but which can alternatively remain exposed on an outer surface without the logo panel, without detracting from the style and appearance of the personal product item.

It is also an object to provide seating at public arenas with multiple venue events, whereby the seating can change to reflect differing venue events, with or without a logo located upon the seats.

It is also an object of the present invention to encourage collection of sports and other public event memorabilia by spectators.

SUMMARY OF THE INVENTION

Stadium seating for skyboxes has now progressed to the use of very comfortable upholstered chairs sometimes displaying a permanent home team logo on the seat back. One such chair is know as a Dreamseat™. Since skyboxes can also be purchased by a corporation, chairs can also have corporate or commemorative logos. Another business environment is to rent skyboxes to a corporation or business just for a single event; a theme for the skybox can be part of the rental fee. It is also desirable to be able to change displayed logo, signage or advertising panels on these chairs to accommodate multi-use on a short term basis such as different afternoon and evening events such as at shared-event stadiums, like the proposed new New York Jets and New York Giant's shared football stadium. A Dreamseat™ can also be retailed for use in a home theater or den. Note that panels can be commonly sized to go from a chair to a jacket and back or into an exhibit collectible storage picture frame. It can also be added to seasonal water cooler covers. Panels can also be common sized in a smaller version for use with smaller articles of clothing such as baseball caps or smaller gear items in general with an attachment feature.

This invention provides a method for attaching non-reversible, interchangeable fabric, leather, vinyl or other suitable natural or synthetic chair-covering material logo (or advertisement or art) panels to upholstered sports stadium chairs or to other personal gear, for example, soft-covered items such as leather jackets or golf bags, without detracting from their appearance, even if the panel is removed, thereby allowing their use without display of an insignia or other type of logo. The panels can also be applied to upholstered vehicle seats, office chairs, office furniture, office water coolers, or other domestic furniture. The system can also be extended to clothing outerwear or sports related accessories such as sports equipment. The attachment method is inconspicuous and keeps the attachment mechanism hidden from view and does not detract from comfort, style or wearability of the product. Such a logo panel can also cover an area emblazoned with a permanent different logo. These panels can be embroidered sports memorabilia with spaces for actual team member signatures or performer autographs, or they can be corporate logos or promotional advertising panels. Panels can also include storage pockets for remote controls or magazines or eye glasses.

The fabric, leather or other suitable chair-covering material panels can be attached by zippers, hook and loop strips, or by a series of fabric, leather or other suitable chair-covering material snaps which are hidden by flaps which blend in with the chair upholstery or adjacent material. In one embodiment, a pin lock engages a loop on the zipper pull to lock the logo panel in place to the chair with an embedded lock ferrule. These features on a skybox chair transform it from a Dreamseat™ to one with an Xzipit)™ feature. In another embodiment, the side of a chair can have vertical attachment strips under hiding flaps with an additional horizontal flap on the bottom to capture the bottom edge of the fabric, leather or other suitable chair-covering material logo panel thereby forming a convenient pocket for magazines or such items. The bottom edge strip is a sewn fabric, leather or other suitable chair-covering material blending in with the upholstery but encasing a flat flexible magnet that is attracted to an embedded similar magnet or to a ferromagnetic metal strip embedded under the chair upholstery in registration with it. This would keep the bottom flap neatly against the side of the chair resisting gravity with the logo panel in place or not. A similar magnetic retention method may be used at the top end of a logo panel which rests on the top edge of the seat back to keep it neatly in place. Also the present invention includes a picture frame Xzipit™ for storage of extra collectable panels. The panel can be placed anywhere on an article where placement thereof is most advantageous in its location for display.

Optionally, heating and/or massage circuitry can be added to the logo panels to provide comfort for the user. These can be set preferably with timers so that they turn off if inadvertently left on by the seat occupant.

BRIEF DESCRIPTION OF THE DRAWINGS

The present invention can best be understood in connection with the accompanying drawings. It is noted that the invention is not limited to the precise embodiments or the precise placement of any logo or commemorative panels shown in drawings, in which.

DETAILED DESCRIPTION OF THE INVENTION

Figure 1:
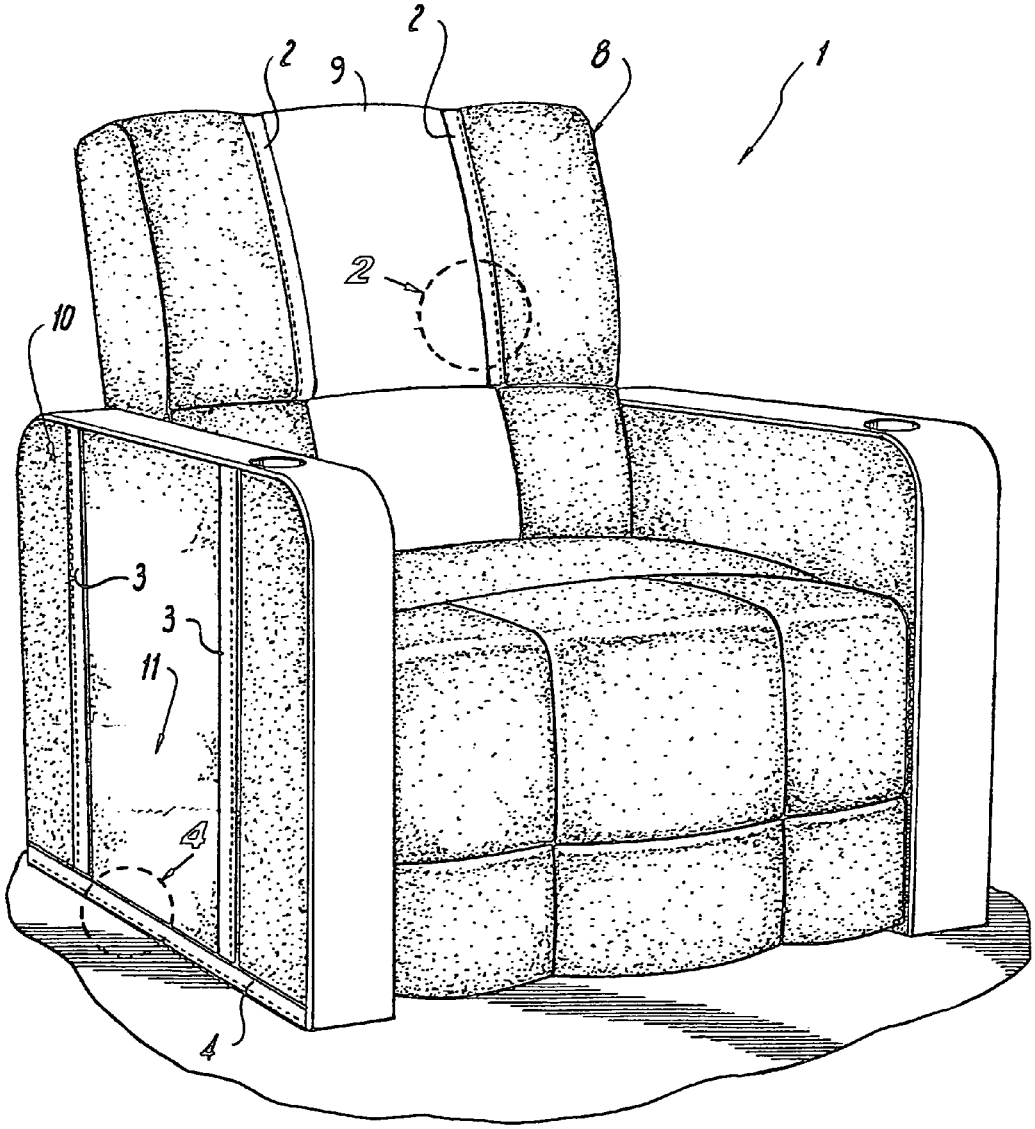
FIG. 1 is a perspective view of the upholstered sky box chair of this invention with fabric, leather or other suitable chair-covering material logo panel attachments shown at the seat back and on the side.

FIG. 1 shows an article of furniture, such as, for example, a Dreamseat™ skybox chair 1 with Xzipit™ attachment features. Fastener receptors, such as, vertical flaps 2, blend in with the upholstery of seat back 8 and cover the attachment means for a fabric, leather, vinyl or other suitable natural or synthetic chair-covering material logo, advertising, art or signage panel; if the panel were present, it would cover area 9 between strips 2. Similarly vertical flaps on seat side 10 cover the attachment means for a logo panel that would be attached above horizontal bottom strip 4; the logo panel would form a pocket covering area 11.

Figure 2:
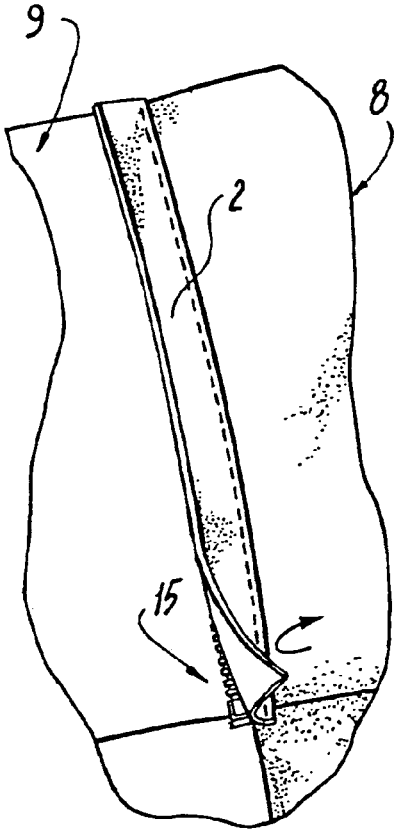
FIG. 2 is a perspective detail showing the hiding flap partially lifted to reveal an attachment zipper.

FIG. 2 shows a detail of flap 2 lifted and revealing zipper 15 underneath.

Figure 3:
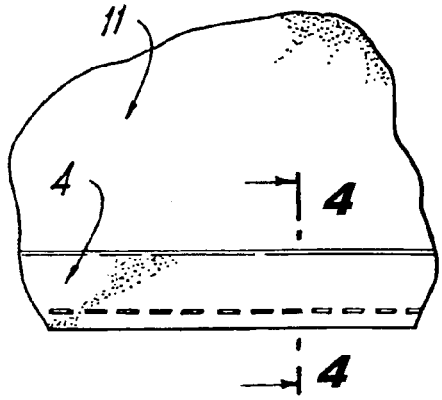
FIG. 3 is a front view detail of a magnetic bottom strip.
Figure 4:
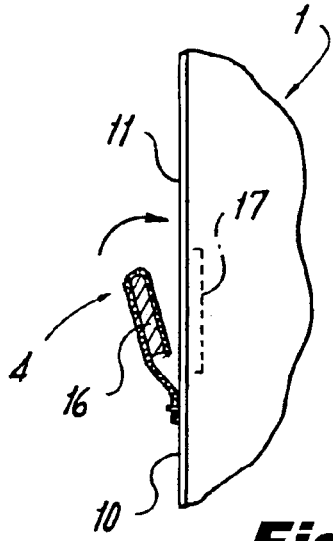
FIG. 4 is a crossectional view of the strip shown in FIG. 3.

FIG. 3 and 4 show details of bottom strip 4 which is held against area 11 by the attraction of flexible magnetic strip 16 to strip 17 behind upholstery of chair side 10. Strip 17 is either a magnet similar to 16 or a ferromagnetic metal strip. If the logo panel were present, the bottom edge would be sandwiched within the open space between strips 16 and 17.

Figure 5:
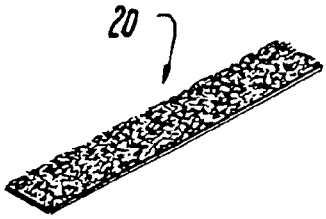
FIG. 5 is a front view of a strip of loop material which would mate with a similar strip of hook material on a fabric, leather or other suitable chair-covering material logo panel bottom surface side edge.

FIG. 5 shows a strip of loop material 20 that can substitute for zipper 15 as a hook and loop attachment alternative. Plastic style Ziploc® bag fasteners can also be used.

Figure 6:
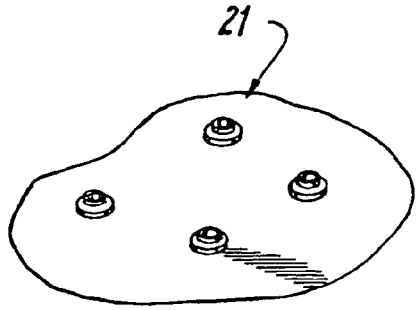
FIG. 6 is a front view detail showing a line of female fabric, leather or other suitable chair-covering material snaps which can be used as another alternative attachment for a fabric, leather, vinyl or other suitable natural or synthetic chair-covering material logo panel with a similar line of mating male fabric, leather or other suitable chair-covering material snaps.

FIG. 6 shows another alternative in the fabric, leather or other suitable chair-covering material snaps 21.

Figure 7:
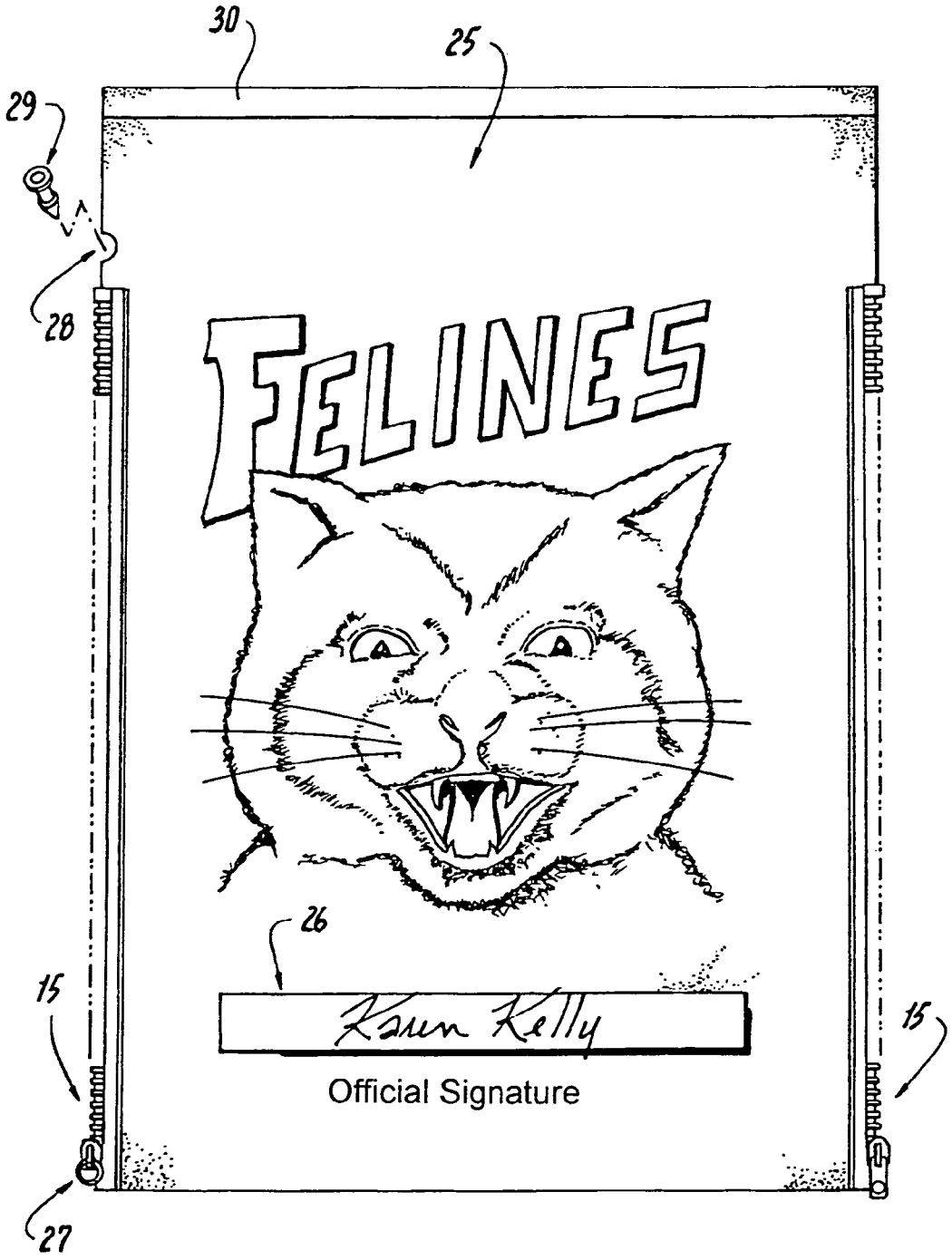
FIG. 7 is a front view of a fabric, leather or other suitable chair-covering material logo panel with zipper attachments at each side.

FIG. 7 shows a non-reversible interchangeable fabric, leather or other suitable chair-covering material logo panel 25 of this invention. It has attachment zippers 15 on each side and optional stiffener 30 or strip magnet at the top edge. Optional signature area 26 is shown below the logo. For a side pocket application, panel 25 would not have the extended portion above the end of zippers 15, and it may be wider. Optional loop 27 on left zipper pull combines with clearance notch 28 and pin lock 29 to provide a method to lock panel 25 to chair 1, if chair 1 has an embedded lock ferrule in registration with notch 28 in an installed panel 25.

Figure 8:
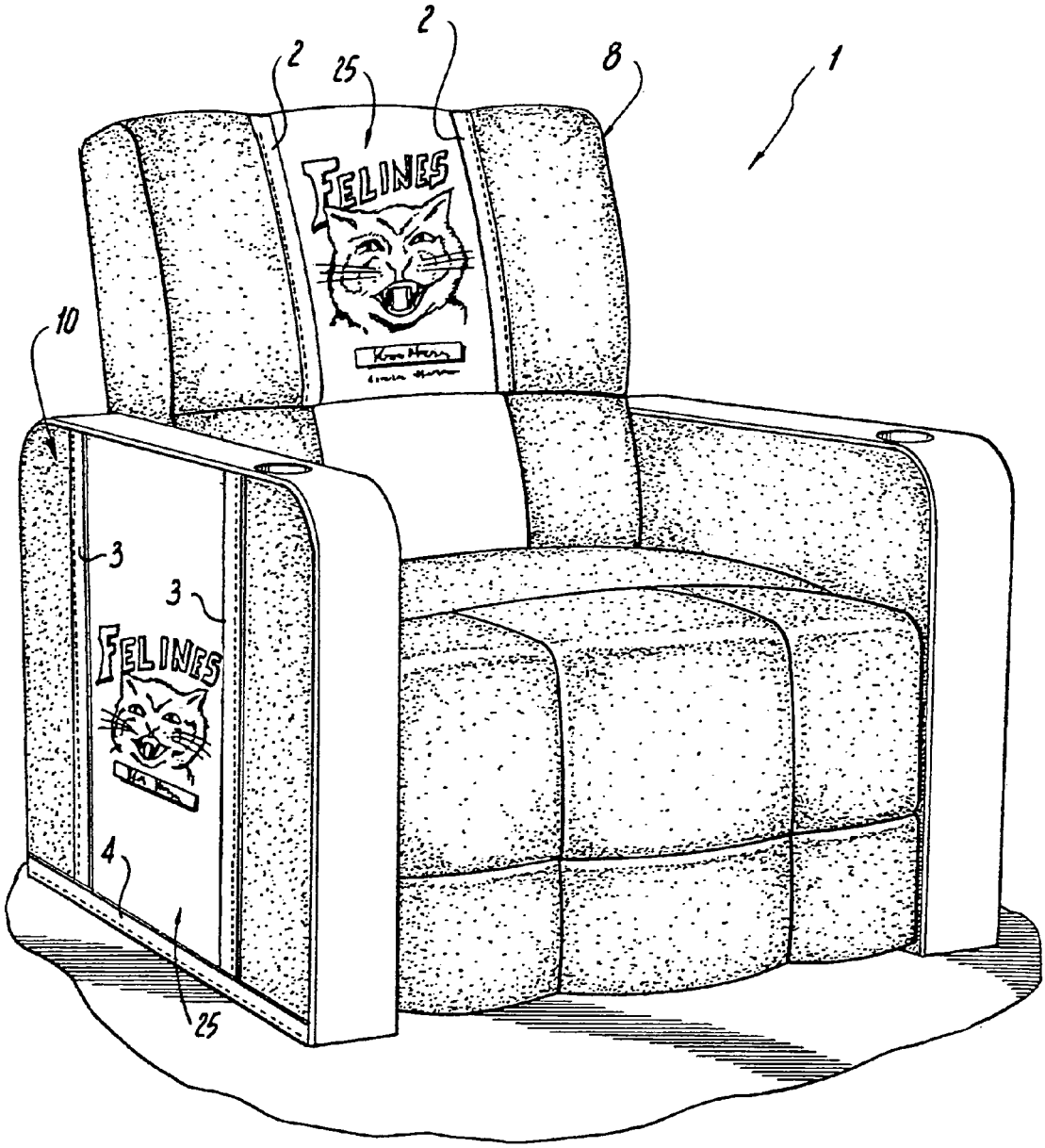
FIG. 8 is a perspective view of the chair of FIG. 1 with two fabric, leather or other suitable chair-covering material logo panels installed.

FIG. 8 shows two optional logo panels 25 installed on chair 1 wherein panel 25 on side 10 constitutes a side pocket.

Figure 9:
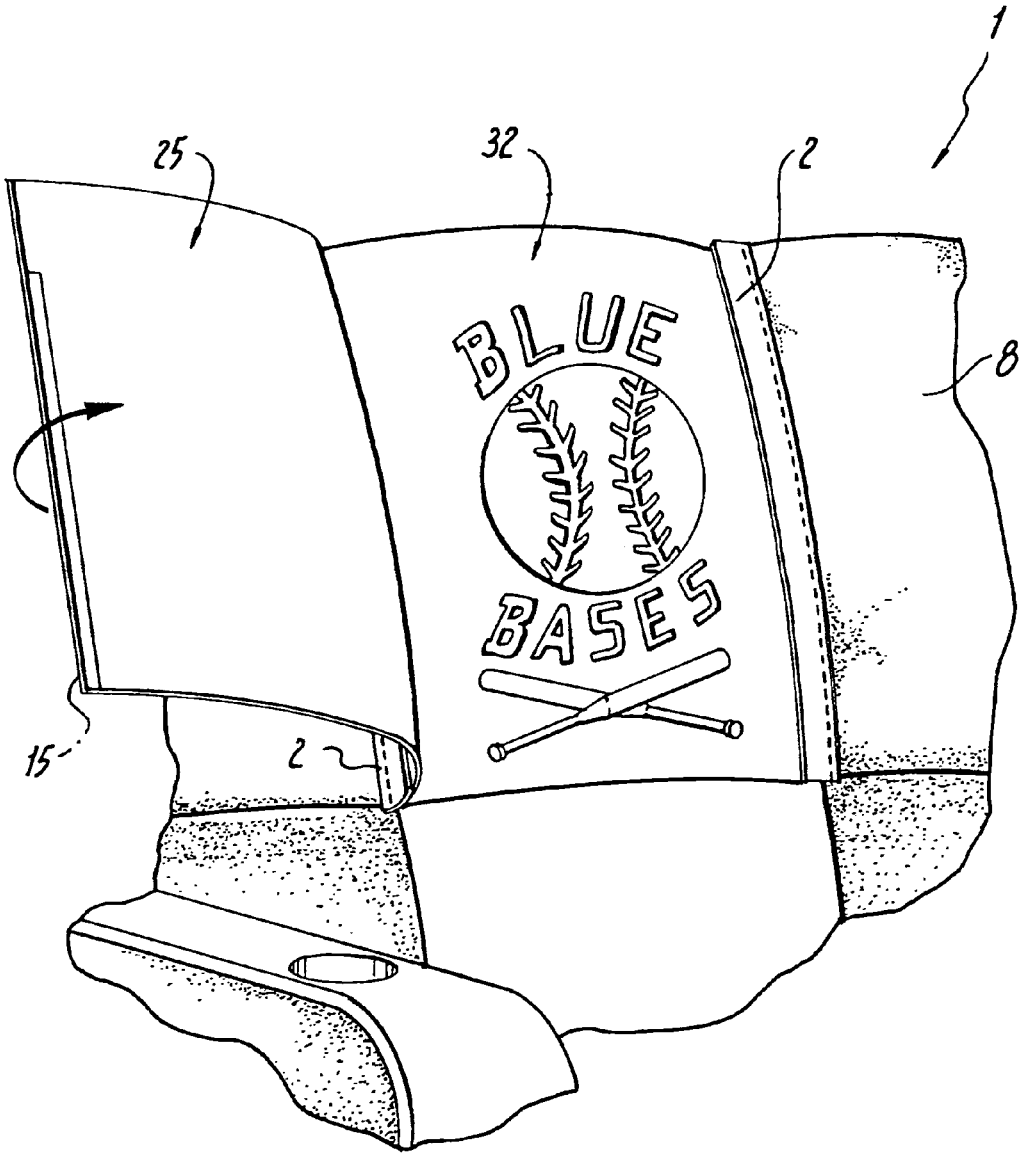
FIG. 9 is a detail perspective view of a fabric, leather or other suitable chair-covering material logo panel being installed over a permanent logo panel on the seat back of a chair.

FIG. 9 is a detail illustrating a permanent logo 32 in the process of being covered by an interchangeable fabric, leather or other suitable chair-covering material logo 25; it is already attached on the left side.

Figure 10:
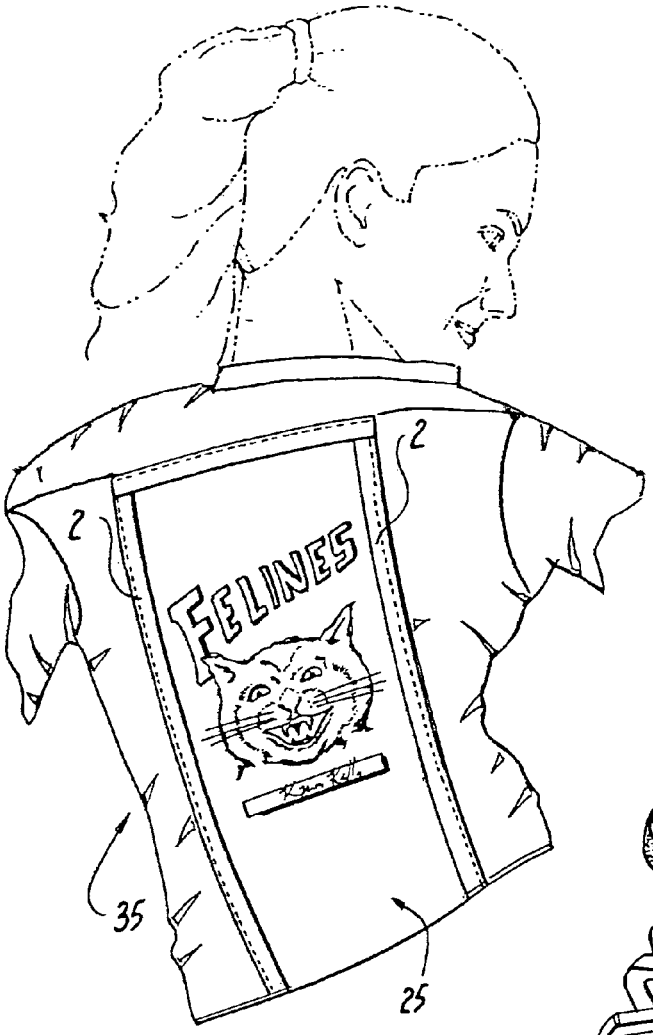
FIG. 10 is a rear view of a leather jacket or track suit or warm up with an interchangeable fabric, leather or other suitable chair-covering material logo panel attached.
Figure 11:
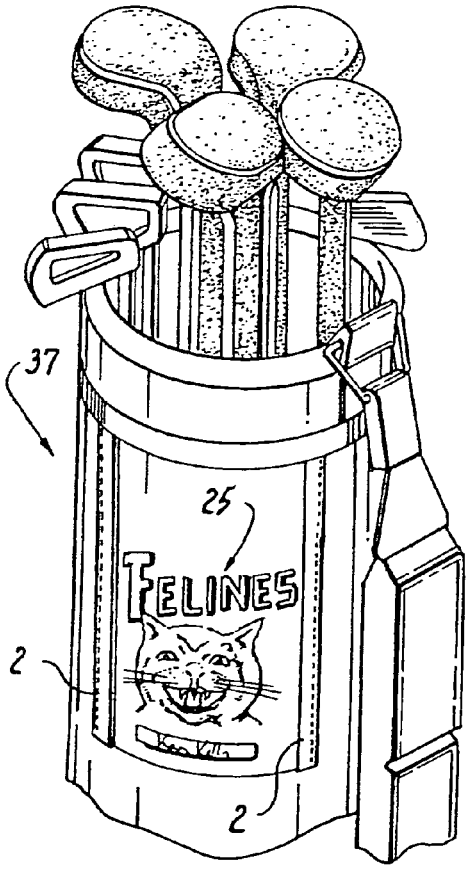
FIG. 11 is a perspective detail of a leather golf bag with an interchangeable fabric, leather or other suitable chair-covering material logo panel attached.

FIGS. 10 and 11 show a non-reversible interchangeable logo panel 25 installed on personal gear, such as, for example, the back of a leather jacket 35 and on a golf bag 37 respectively using methods similar to those for back 8 of chair 1.

Figure 12:
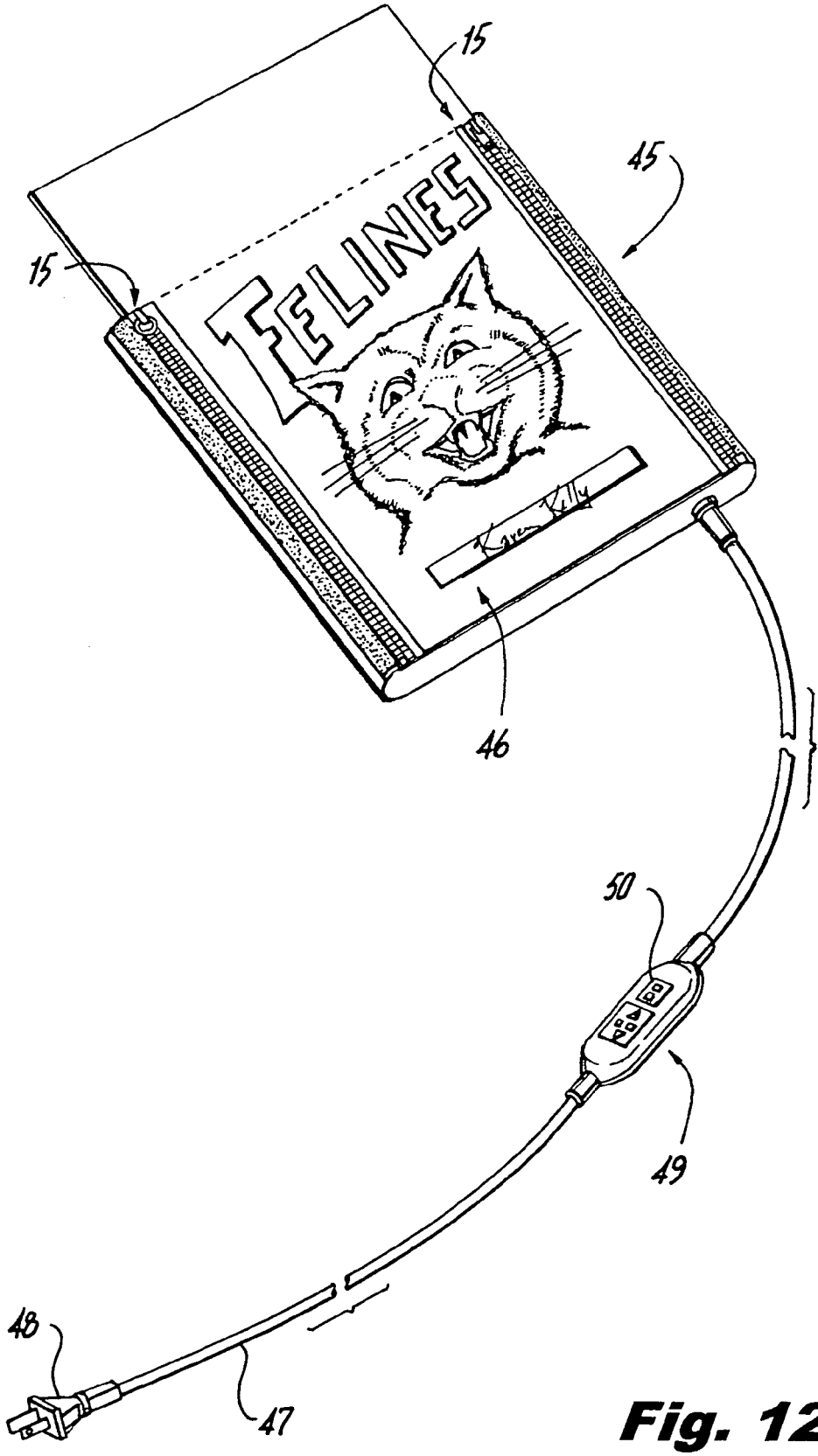
FIG. 12 is a perspective view of a logo patch as an integral surface of a heating pad.

FIG. 12 shows an alternate embodiment of this invention which implements optional logo patch 45 as a heating pad wherein the logo patch is the top surface. The lower portion 46 up to the length of zippers 15 houses the heating element. Typical heating pad control 49 offers multiple heat settings (displayed in liquid crystal display (LCD) 50), on/off, timer, and automatic shut-off. Line cord 47 with wall plug 48 supplies power.

Figure 14:
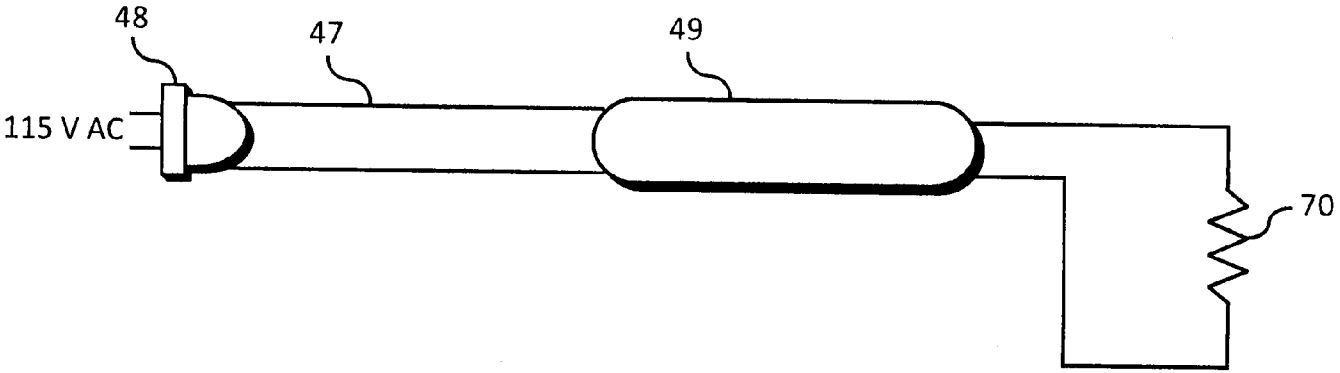
FIG. 14 shows a schematic diagram of a typical heating pad as may be used as the basis of the logo patch heating pad of FIG. 12.

The schematic diagram of FIG. 14 shows heating element 70 as controlled by control 49.

Figure 13:
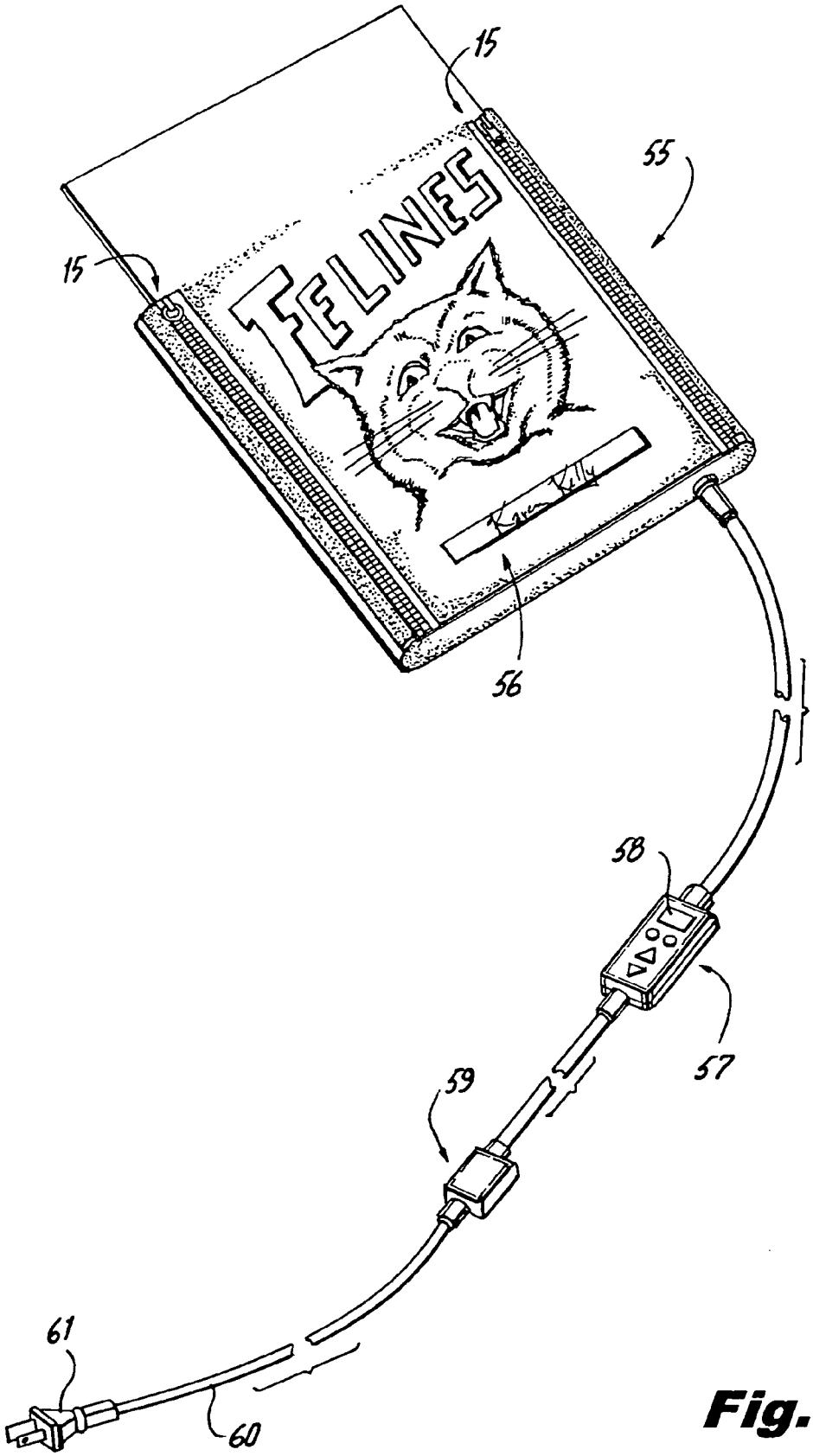
FIG. 13 is a perspective view of a logo patch as the top surface of a massage mat for use on a chair.

FIG. 13 shows yet another alternate embodiment wherein the logo patch is used as the top surface of an optional massage mat 55 as used on a chair. A control 57 with LCD 58 is used to control the massage or vibration elements within the lower portion 56 of logo massage 55 which is attached via side zippers 15. AC/DC power supply 59, if required, is located on line cord 60 with wall plug 61.

Figure 15:
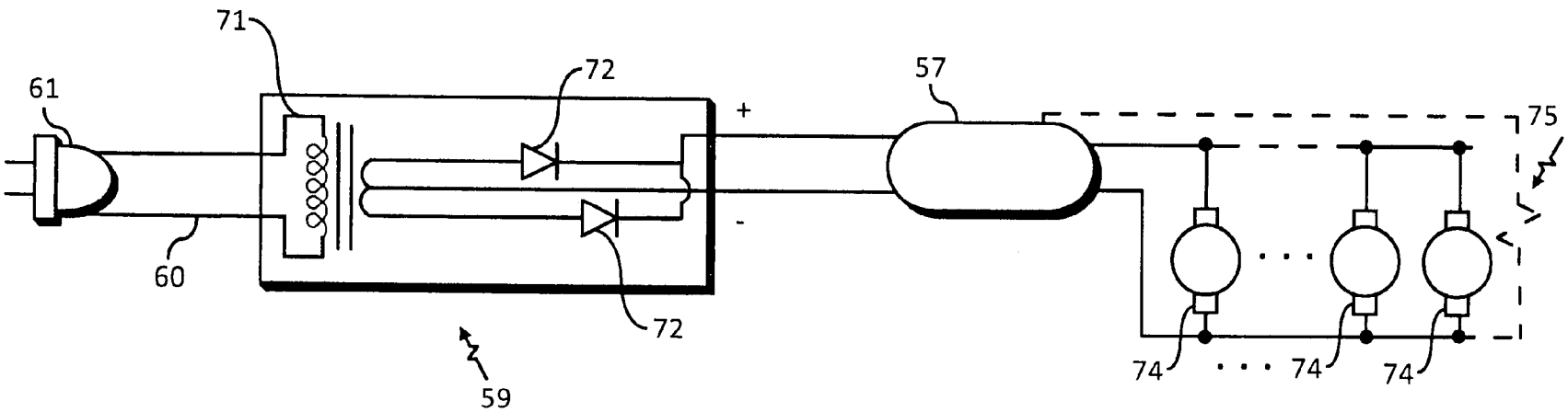
FIG. 15 is a typical schematic diagram of a massage mat that may be used as the basis for the logo patch massage mat of FIG. 13; it shows an optional heating element as well.

FIG. 15 shows a possible schematic diagram of an optional massage unit using step-down transformer 71 and rectifiers 72 feeding control 57 with low voltage DC. The massage motors 74 or vibration elements 74 are dispersed throughout mat 56. An optional heating element 75 can also be added to form another embodiment of this invention supplying both heat and massage/vibration emanating from a mat with a logo patch facing.

Figure 16:
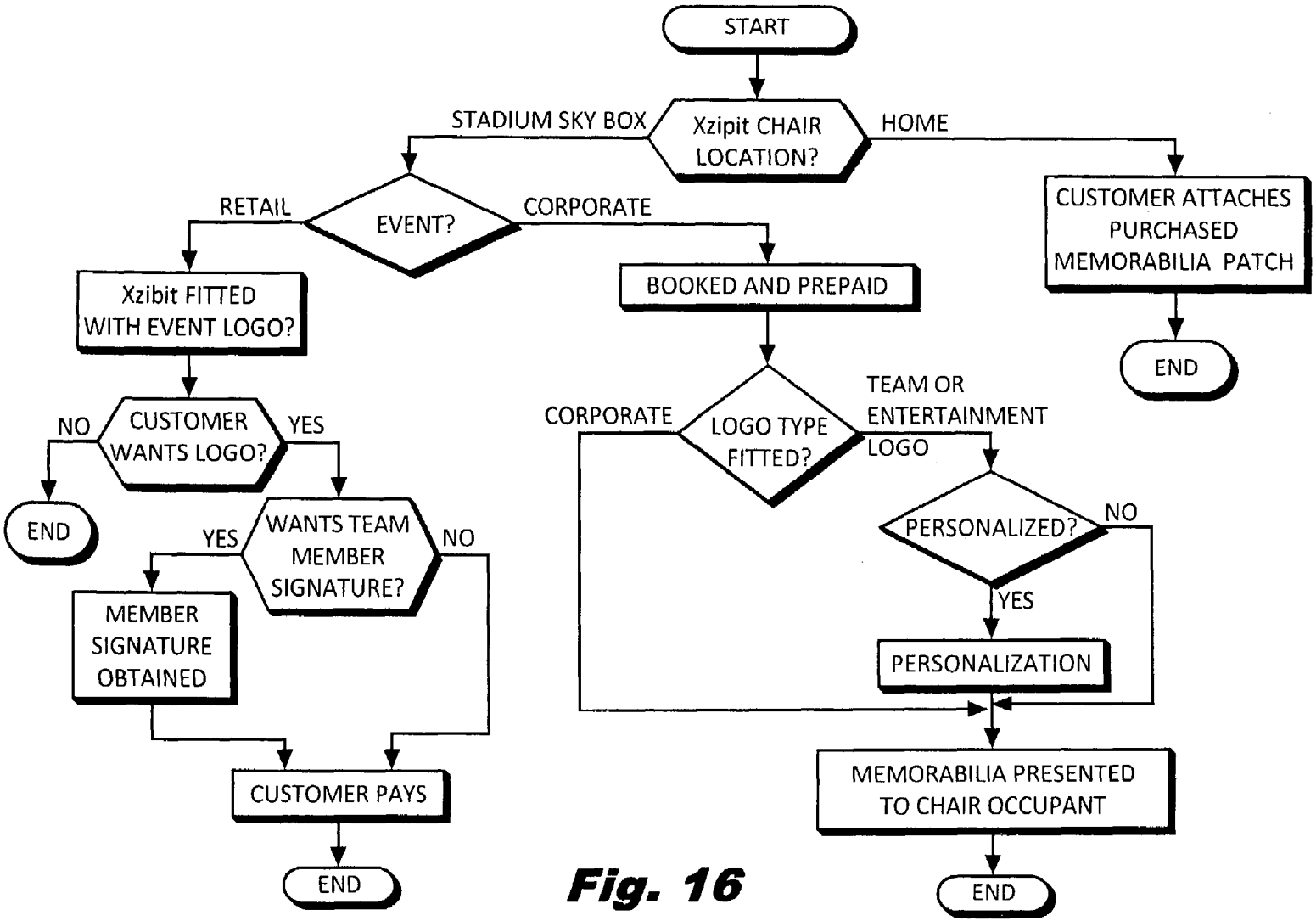
FIG. 16 is a flow chart detailing some of the possible business transactions relating to commerce involving interchangeable fabric, leather or other suitable chair-covering material logo, art, signage or advertising or personal message panels.

FIG. 16 is a flow chart detailing some of the business options associated with the system of providing adaptable, stand alone furniture or other personal gear with receptors being provided with or without fabric, leather or other suitable chair-covering material logo panels of this invention. If the upholstered chair or other personal gear with attachment features is in a home location, a memorabilia fabric, leather or other suitable chair-covering material logo panel purchased at a sporting event can be attached to it and changed after next event. If the Xzipit™ chair is in a stadium sky box, the present event for which it is being used can be either a retail or a corporate event. For a retail event, the chair would be fitted with an event logo such as a sports team or a music concert event or photo. If the seated customer wants a logo he would pay for it after the event and it would be removed from his seat and he would take it with him. He could optionally request a custom team member signature for which there would be an extra charge. The logo panel can include advertising material such as, for example, sports emblems, corporate logos, photographs, memorabilia, caricatures of event mascots, public characters, entertainment symbols, geographic denominations or other group affiliated indicia.

If the skybox or club area is rented for a corporate event, the skybox is typically booked and prepaid. As part of the theme for the corporate event either team/entertainment event logos or corporate logos, personal messages or photos are preinstalled on the Dreamseats™. Not limited to a current style. Xzipit™ can be fit on any furniture style including coaches and automobile seats as well as motorcycle seats and saddles. There may be an option for personalization as by autograph. The memorabilia for the corporate event is removed from the chair, optionally personalized, and then given to the occupant of that chair. If the skybox is owned by a corporation or seasonally leased, combination corporate/event logo panels can be installed and given as souvenirs to the corporate guests to commemorate their attendance.

Other business options not explicitly indicated in FIG. 16 relate to a retail environment such as a department store where a variety of different items such as furniture, clothing, or other gear items with Xzipit™ features are displayed. Memorabilia panels with licensed logos can be ordered or sold at the same retail outlet or ordered separately from web sites or purchased at sporting events.

Figure 17:
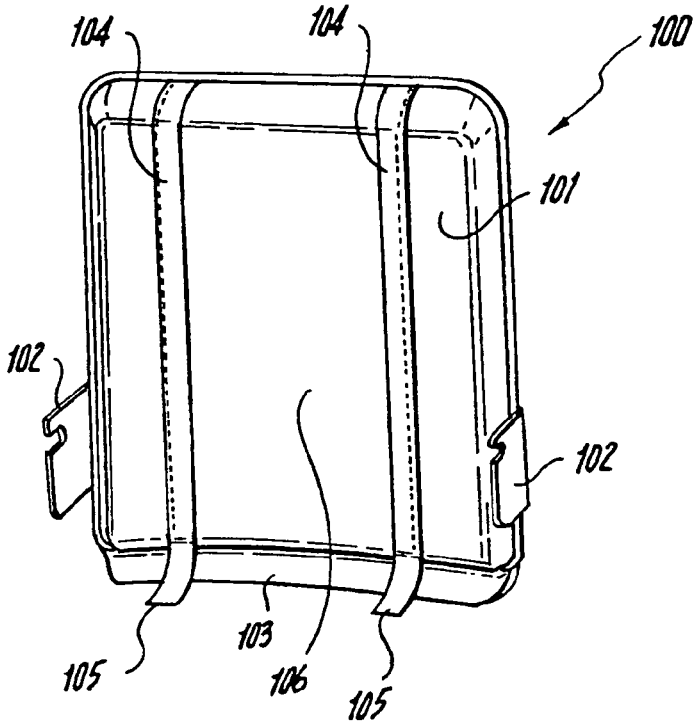
FIG. 17 is a perspective view of an upholstered removable seat back with a feature to accept a memorabilia panel (whereby the panel is not shown installed); and, FIG. 18 is a perspective view of an office chair with a logo panel installed.
Figure 18:
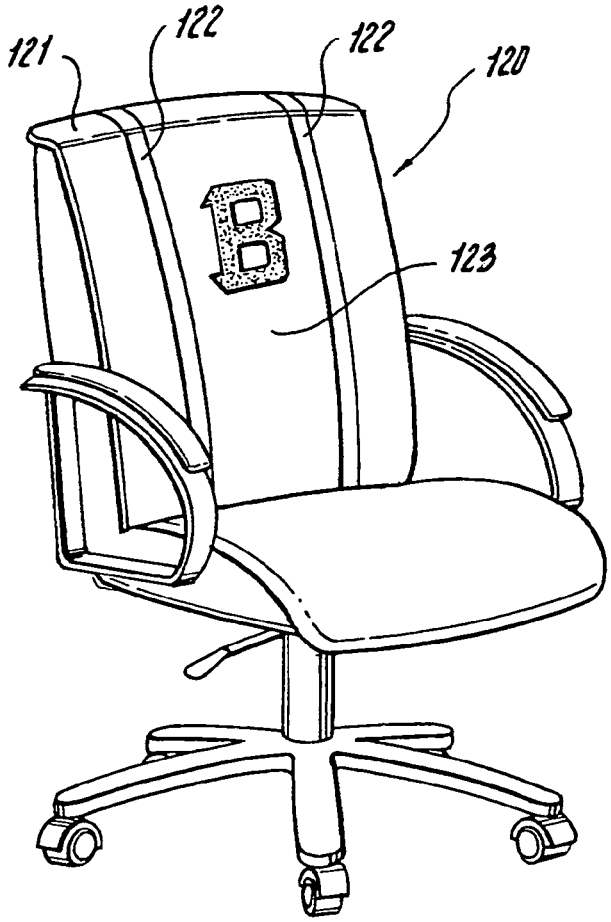

Two other seating options with Xzipit™ features are shown in FIGS. 17 and 18. In FIG. 17, a removable upholstered seat back 100 is shown. These types of seat backs are compatible with seating at many sports stadiums. They are attached via brackets 102 which support the back cushion 101; a bottom recess 103 provides space for an optional seat cushion. Flaps 104 conceal the attachment method of the Xzipit™ feature; they are permanently attached to back cushion 101 and do not interfere in any manner with use of the seat cushion without a logo panel installed in the upholstered region 106. Ends 105 are extensions of the attachment feature (such as zippers) which accommodate the logo panel behind the optional seat cushion (not shown).

FIG. 18 shows an office chair 120 with Xzipit™ attachment flap strips 122 on chair back 121 with logo panel 123 installed. If panel 123 were removed, seat back 121 would look perfectly normal between flap strips 122 since the region is fully upholstered in matching fabric.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention.

I claim:

1. An adaptable stand alone article of furniture comprising:

a pair of spaced, extending flaps on a front surface of said article of furniture, said flaps attached along outer edges to said article of furniture so that said flaps open facing each other;

said front surface having a region between said pair of spaced, extended flaps, said region being made of the same material as a remainder of said front surface outside of said region between said flaps;

a panel of distinctive design located between said flaps and having side edges hidden under said flaps;

means for removably attaching said side edges to said front surface of said article of furniture under said flaps; and a logo on a front surface of said panel of distinctive design whereby:

a) said panel can be replaced by at least one of another panel having a different logo thereon or, b) by an exposed region located between said pair of flaps.

2. The adaptable stand alone article of furniture as in claim 1 wherein said article of furniture is a chair;

said chair having a comfortable seat and a comfortable back;

said removable panel of distinctive design mounted on said chair;

said means for removably attaching said logo panel being chair having hidden attachments for receiving said removable panel, said chair being suitable for use with or without mounting of said removable panel; and whereby said panel is replaceable by said another panel having a different distinctive design and said panel is moveable to another chair, or, by said exposed region located between said pair of flaps.

3. The adaptable stand alone article of furniture of claim 2 in which said attachments are hidden in an upholstered finish of said chair when said panel is removed whereby said chair is usable with said exposed region without said removable panel.

4. The adaptable stand alone article of furniture of claim 2 in which said chair has said flaps to hide said attachments.

5. The adaptable stand alone article of furniture of claim 1 in which said attachments comprise zippers.

6. The adaptable stand alone article of furniture of claim 5 having a zipper pull engaged with a lock embedded in said chair to prevent unauthorized removal of said panel from said chair.

7. The adaptable stand alone article of furniture of claim 1 in which said attachments are hook and loop connectors.

8. The adaptable stand alone article of furniture of claim 1 in which said attachments comprise magnetically attached strips.

9. The adaptable stand alone article of furniture of claim 8 in which said magnetically attached strips are mounted under cover material of said chair and said removable panel whereby said magnetic strips are not visible to a user of said chair.

10. The adaptable stand alone article of furniture of claim 1 in which said panel has advertising material on a front, surface visible to the user.

11. The adaptable stand alone article of furniture of claim 1 in which said distinctive design of said panel is relevant to a venue in which said chair is being used.

12. The adaptable stand alone article of furniture of claim 2 in which said chair has an upholstered seat.

13. The adaptable stand alone article of furniture of claim 2 in which said chair has an upholstered back.

14. The adaptable stand alone article of furniture of claim 2 in which said chair has an upholstered seat and back.

15. The adaptable stand alone article of furniture of claim 14 in which said chair has upholstered arm rests.

16. The adaptable stand alone article of furniture of claim 15 in which said removable panel is mounted on an arm rest.

17. The adaptable stand alone article of furniture as in claim 16 in which:

said arm rest has a second pair of spaced, vertically extending flaps on a surface of said arm rest, said second pair of flaps attached along outer edges thereof to said arm rest so that said second pair of flaps open facing each other;

a second panel between said second pair of flaps and having side edges hidden under said second pair of flaps;

means for removably attaching said side edges of said second panel to said surface of said arm rest under said second pair of flaps; and a logo on a front surface of said second panel whereby said second panel can be replaced by another panel having a different logo thereon or by no panel.

18. The adaptable stand alone article of furniture of claim 1 in which said panel incorporates a heating element, said chair having a heating pad control for selecting a heat setting for said heating element.

19. The adaptable stand alone article of furniture of claim 1 in which said panel incorporates massage elements, said chair having a control for selecting a mode of operation of said massage elements.

20. The adaptable stand alone article of furniture of claim 19 in which said massage elements of said panel incorporate a massage unit using a step-down transformer and a plurality of rectifiers feeding a controller with low voltage DC for powering a plurality of massage motors and/or vibration elements dispersed throughout said massage unit, said massage unit being controlled by said controller for selecting a mode of operation of said massage elements.

21. The combination of claim 20 wherein said both a heating element and a massage unit supplying both heat and massage/vibration.

22. The adaptable stand alone article of furniture of claim 1 in which a top edge of said panel has a stiffener.

23. The adaptable stand alone article of furniture as in claim 1 in which said distinctive design of said removable panel includes a logo.

24. The adaptable stand alone article of furniture of claim 1 in which said distinctive design of said removable panel includes advertising material.

25. The adaptable stand alone article of furniture of claim 1 in which said distinctive design of said removable panel includes commemorative material.

26. The adaptable stand alone article of furniture of claim 1 in which said distinctive design of said removable panel includes a photograph.

27. The adaptable stand alone article of furniture of claim 1 in which said distinctive design includes material relating to an event, wherein a user of said personal product item keeps said a removable panel as a souvenir upon completion of said event.

28. The adaptable stand alone article of furniture of claim 27 in which said first removable panel is personalized for said user.

29. The adaptable stand alone article of furniture of claim 27 in which said distinctive design of said removable panel is relevant to a sports team or event of interest to a user.

30. The adaptable stand alone article of furniture of claim 1 in which said advertising material is selected from the group consisting of sports emblems, corporate logos, memorabilia, caricatures of event mascots, public characters, entertainment symbols, geographic denominations or group affiliated indicia.

31. An adaptable stand alone chair comprising:

said chair having an upholstered seat, an upholstered backrest and upholstered armrests;

a pair of spaced, extending flaps on at least one surface of said chair, said flaps attached along outer edges to said chair so that said flaps open facing each other;

said at least one surface of said chair having a region between said pair of spaced, extended flaps, said region being made of the same material as a remainder of said at least one surface of said chair located outside of said region between said flaps;

a panel of distinctive design located between said flaps and having side edges hidden under said flaps;

said panel of distinctive design bearing indicia selected from the group consisting of advertising material, a design having a theme relevant to a venue in which said chair is being used, logos, sports emblems, corporate logos, photographs, memorabilia, commemorative material, caricatures of event mascots, public characters, entertainment symbols, geographic denominations or group affiliated indicia;

means for removably attaching said side edges to said front surface of said chair under said flaps; said means for removably attaching said logo panel being chair having hidden zipper attachments for receiving said removable panel, whereby further said panel is replaceable by said another panel having a different distinctive design and said panel is movable to another chair, or, by said exposed region located between said pair of flaps;

said zipper attachments being hidden in an upholstered finish of said chair when said panel is removed whereby said chair is usable with said exposed region without said removable panel.

32. The adaptable stand alone chair as in claim 31 further comprising a zipper pull of said zipper attachment being engaged with a lock embedded in said chair to prevent unauthorized removal of said panel from said chair.

* * * * *